US005588191A

United States Patent [19]

Sølbeck

[11] Patent Number: 5,588,191

[45] Date of Patent: Dec. 31, 1996

[54] ANCHORING EYELET FOR TARPAULINS AND SIMILAR COVERINGS

[75] Inventor: Peter Sølbeck, Rungsted Kyst, Denmark

[73] Assignee: Polysheet A/S, Herlev, Denmark

[21] Appl. No.: 416,891

[22] PCT Filed: Sep. 30, 1993

[86] PCT No.: PCT/DK93/00314

§ 371 Date: Apr. 20, 1995

§ 102(e) Date: Apr. 20, 1995

[87] PCT Pub. No.: WO94/09232

PCT Pub. Date: Apr. 28, 1994

[30] Foreign Application Priority Data

| | | | |
|---|---|---|---|
| Oct. 20, 1992 | [DK] | Denmark | 1278/92 |
| Dec. 28, 1992 | [DK] | Denmark | 1564/92 |

[51] Int. Cl.[6] ..... A43C 5/00

[52] U.S. Cl. ..... 24/713.6; 24/713.7; 24/713.8

[58] Field of Search ..... 24/713.6, 713.7, 24/713.8, 461, 459, 522, 114.8, 114.12; 135/119

[56] References Cited

U.S. PATENT DOCUMENTS

| | | | |
|---|---|---|---|
| 307,867 | 11/1884 | Parker | 24/713.6 |
| 624,150 | 5/1899 | Andrus | 24/713.7 |
| 701,476 | 6/1902 | Force | 24/713.8 |
| 826,672 | 7/1906 | Landmaid | 24/713.7 |
| 872,237 | 11/1907 | Hughes | 24/713.8 |
| 2,393,984 | 2/1946 | Gookin | 24/713.7 |
| 3,653,353 | 4/1972 | Davis | 24/713.7 |
| 3,979,798 | 9/1976 | Meyer | 24/713.7 |

FOREIGN PATENT DOCUMENTS

| | | | |
|---|---|---|---|
| 0278698 | 4/1965 | Australia | 24/713.7 |
| 0329006 | 7/1903 | France | 24/713.8 |
| 1229572 | 4/1971 | United Kingdom | 24/713.8 |
| 1437700 | 6/1976 | United Kingdom | 24/713.7 |
| 91/00801 | 1/1991 | WIPO . | |

*Primary Examiner*—Victor N. Sakran
*Attorney, Agent, or Firm*—Beveridge, DeGrandi, Weilacher & Young, L.L.P.

[57] ABSTRACT

An anchoring eyelet for tarpaulins and similar coverings of a thermoplastic foil material is designed as a substantially annular disc (1) made of plastic. The eyelet has an eyelet opening (2) and is designed in its peripheral part with increased resiliency by means of indentations which may be formed by radially extending resilient tongues (3) or lobes. This avoids any tendency of the eyelets to become detached after being pressed in, while forming notches at heavy loads.

12 Claims, 2 Drawing Sheets

ANCHORING EYELET FOR TARPAULINS AND SIMILAR COVERINGS

Figure 1:
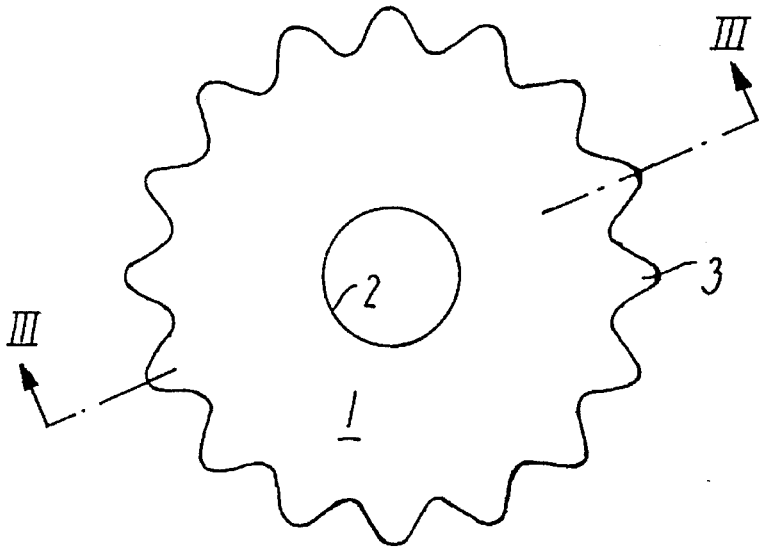

The invention relates to an anchoring eyelet for tarpaulins and similar coverings of a thermoplastic foil material, which eyelet is designed as a relatively thin, flat and substantially annular disc of plastic material provided with an eyelet opening.

Tarpaulins of a thermoplastic foil material, possibly with a net reinforcement, is used extensively for covering scaffolding in connection with construction works and for numerous covering purposes, for example for protection of materials and equipment stored out in the open.

For the purpose of fastening to supporting structures or interconnection, the tarpaulins are provided with anchoring eyelets which are pressed into the foil material in direct connection with the extrusion such as is known from international patent application No. WO 91/00801.

The tarpaulin eyelets used so far are shaped as relatively thin and stiff annular discs having a circular, relatively sharp-edged outer periphery.

For tarpaulins with inserted eyelets of this type there may be a certain risk of notch formation at the eyelet edges, partly in connection with the pressing of the eyelets into the foil material, the consequence of which is that at later heavy loads, for example wind loads and tensile influences on the eyelets from the anchor straps, the eyelets risk becoming detached from the foil material.

This problem is remedied according to the invention through a design of anchoring eyelets which are characterized in that the peripheral part of the eyelet disc is designed with indentations to provide increased resiliency to said peripheral part.

For conventional barrel type eyelets intende to be fastened in leather and similar materials by clenching it is known from US-A-872,237 to provide an outwardly turned flange portion forming the head of the eyelet with slots forming a series of petals which can be individually seated in the material to allow an even setting of the eyelet also in presence of a foreign substance on the material.

The design of the peripheral part of the eyelet disc with increased resiliency through the provision of indentations has proved in practice to eliminate or at least highly reduce the above tendency to notch formation, as transversely acting load forces seeking to detach the tarpaulin from the eyelets are substantially transformed into shear forces in the plane of the tarpaulin, because the peripheral edge zone of the disc acts as a supple joint between the relatively stiff middle part of the eyelet disc and the surrounding foil material of the tarpaulin.

The indentations may be designed in various ways. In a very simple embodiment, the increased suppleness may thus be obtained by designing a ring of holes of an arbitrary shape within the periphery of the disc.

However, a preferred embodiment is characterized in that indentations are formed by radially extending resilient tongues or lobes at the periphery of the eyelet disc.

This also entails the further advantage that the external peripheral length of the eyelet discs is increased in consequence of the radially extending Tongues.

The desired resiliency of the peripheral part of the eyelet disc may further be increased by designing further openings in the form of holes in the resilient tongues or lobes.

In comparison with conventional eyelets, which are often exposed to considerable wear at the eyelet opening edge despite their implementation in a relatively stiff material, the increased resiliency of the peripheral part of the disc opens up a favourable possibility of reinforcement of the central part of the disc around the eyelet opening, for example by means of a reinforcing ring.

The anchoring eyelets according to the invention may be pressed into the foil material directly in connection with the extrusion, while the material is still soft, but may also be fastened by heat sealing or adhesion. Independently of the fastening method it may be appropriate for the indentations between the tongues to have a rounded bottom, in order to ensure sturdy sealing to the foil material.

Figure 2:
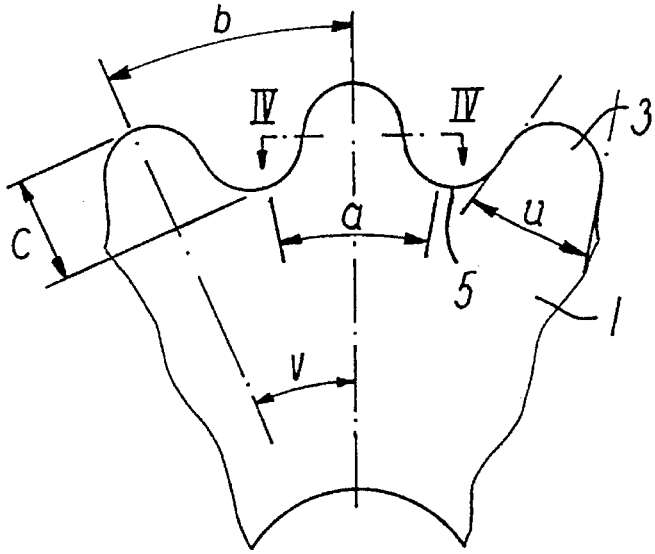
Figure 3:
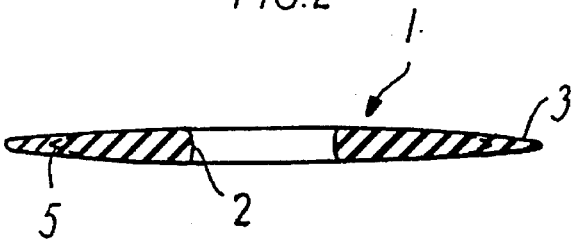
Figure 4:
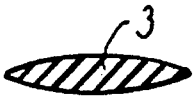
Figure 5:
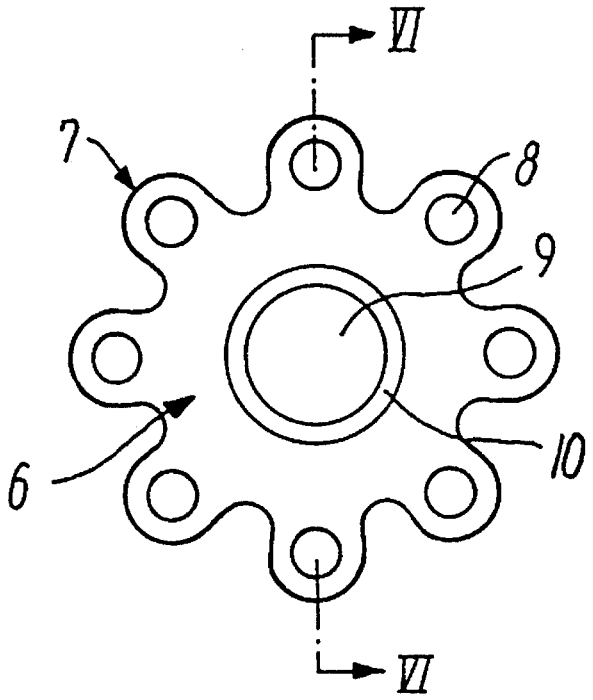
Figure 6:
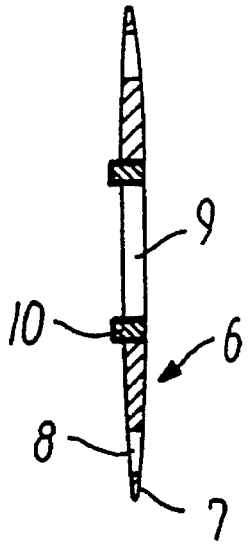

The invention will now be explained in further detail with reference to the drawings, in which FIG. 1 is a plane view of an embodiment of an anchoring eyelet according to the invention, FIG. 2 is an enlarged partial view of the eyelet of FIG. 1, FIGS. 3 and 4 show sectional views along the lines III—III and IV—IV of FIGS. 1 and 2, respectively, and FIGS. 5 and 6 show a modified embodiment.

The anchoring eyelet shown in FIG. 1 is designed as a substantially annular disc 1 having an eyelet opening 2 which is shown in a position in the centre of the disc 1, but which may also be in an off-centre position.

In accordance with the invention, the peripheral part of the eyelet disc 1 is designed with increased resiliency by means of indentations which, in the embodiment shown, are formed by radially extending resilient tongues 3 at the periphery of the disc.

The disc 1 is made of a suitable thermoplastic material such as linear low-density polyethylene (LLDP), and the resiliency of the tongues 3 is increased by the fact that the thickness of the disc 1 decreases from the inner edge at the eyelet opening 2 towards the periphery of the disc at the end of the tongues 3, such as it appears from FIG. 3. The tongues 3 are preferably evenly distributed along the circumference of the disc 1, for example at an angle of division v of 22.5° as shown in FIG. 2, corresponding to a total of 16 tongues.

The shape of the individual tongues 3 may suitably be so that the width a of the tongue is substantially equal to the distance b between the freely extending ends of neighbouring tongues, corresponding to an angle u of 45° between the two side edges of the tongue.

The radial length c of each tongue is adapted to the periphery of the disc and may be from 5 to 15 per cent, preferably about 10 per cent thereof, which has proved to give a suitable elastic deformability of the tongues.

To ensure sturdy sealing at the fastening of the eyelets in a thermoplastic foil material, which may be done either by pressing in connection with extrusion of the material as explained in said international patent application, or by subsequent heat sealing or adhesion, the indentation 4 between the tongues is preferably designed with a rounded bottom as shown in FIG. 2.

The tapering of the disc towards the periphery is also, as shown in FIG. 3, implemented at the bottoms 5 of the tongues, and correspondingly, the individual tongues 3 have a lens-shaped convex cross section as shown in the enlarged sectional view in FIG. 4, so that all the way round along the circumference, the disc 1 exhibits a uniformly slight material thickness adapted to the foil in which the eyelets are to be placed.

In the modified embodiment shown in FIGS. 5 and 6, the resiliency of the peripheral part of the eyelet disc 6 is further increased by circular holes 8 being formed in the radially extending Tongues 7, of which there are eight in this embodiment.

At the same time, the strength of the disc 6 immediately around the eyelet opening 9 is increased by means of a reinforcing ring 10, which may, for example, be made of metal.

I claim:

1. An anchoring eyelet for tarpaulins and similar coverings of a thermoplastic foil material, which eyelet is designed as a relatively thin, flat and substantially annular disc (1) of plastic material provided with an eyelet opening (2), characterized in that the peripheral part of the eyelet disc is designed with indentations to provide increased resiliency to said peripheral part.

2. An anchoring eyelet according to claim 1, characterized in having radially extending resilient tongues (3) or lobes at the periphery of the eyelet disc (1).

3. An anchoring eyelet according to claim 2, characterized in that the individual tongues (3) or lobes (3) have a substantially lens-shaped convex cross-sectional profile at right angles to the corresponding radius of the eyelet disc.

4. An anchoring eyelet according to claim 2 characterized in that the tongues (3) are evenly distributed along-the circumference of the disc (1) and have a distance (b) between their outer ends corresponding substantially to the width (a) of each tongue at its foot.

5. An anchoring eyelet according to claim 3, characterized in that further cuts in the form of holes (8) have been formed in the resilient tongues or lobes (7).

6. An anchoring eyelet according to claim 4, characterized in that the radial length (c) of each tongue (3) is 5–15 per cent, preferably 10 per cent, of the maximum diameter of the eyelet disc between diametrically opposite tongue tips.

7. An anchoring eyelet according to claim 3, characterized in that the indentations (4) between the tongues have rounded bottoms (5).

8. An anchoring eyelet according to claim 1, characterized in that the thickness of the eyelet disc (1) is smaller at the periphery than at the internal edge around the eyelet opening (2).

9. An anchoring eyelet according to claim 8, characterized in that the thickness of the eyelet disc (1) decreases substantially evenly towards the periphery of the disc.

10. An anchoring eyelet according to claim 1, characterized in that the eyelet disc (6) is designed with a reinforcing ring (10) around the eyelet opening (9).

11. An anchoring eyelet according to claim 1 wherein the diameter of the disk is larger than the thickness of the disk.

12. An anchoring eyelet according to claim 1 wherein the thickness tapers to the periphery.

* * * * *